US009586734B2

(12) United States Patent
Costello et al.

(10) Patent No.: US 9,586,734 B2
(45) Date of Patent: Mar. 7, 2017

(54) FLUID CONTAINMENT AND DISPENSING SYSTEM

(75) Inventors: Mark Martin Costello, County Mayo (IE); Tony Doherty, County Mayo (ID); Aaron N. Ingram, Canton, GA (US); Anthony C. Lair, Alpharetta, GA (US)

(73) Assignee: NEOMED, INC., Woodstock, GA (US)

( * ) Notice: Subject to any disclaimer, the term of this patent is extended or adjusted under 35 U.S.C. 154(b) by 826 days.

(21) Appl. No.: 13/191,721

(22) Filed: Jul. 27, 2011

(65) Prior Publication Data

US 2012/0065608 A1 Mar. 15, 2012

Related U.S. Application Data

(60) Provisional application No. 61/368,023, filed on Jul. 27, 2010, provisional application No. 61/388,057, (Continued)

(51) Int. Cl.
*B67D 7/60* (2010.01)
*B65D 47/20* (2006.01)
(Continued)

(52) U.S. Cl.
CPC ..... *B65D 47/2031* (2013.01); *A61J 9/00* (2013.01); *B65D 47/08* (2013.01);
(Continued)

(58) Field of Classification Search
CPC ..... B65D 83/005; B65D 83/62; B65D 83/38; B65D 88/78; B65D 83/70; B65D 47/2031; B65D 47/2018; B65D 47/2093; B65D 1/32; B65D 47/2087; B65D 47/286; B65D 47/061; B65D 47/0866; B65D 25/42; B65D 47/063; B65D 47/046; B65D 90/54; B65D 47/305; B65D 41/0414; B65D 47/0847;
(Continued)

(56) References Cited

U.S. PATENT DOCUMENTS 2,303,997 A 12/1942 Hogg
2,361,647 A * 10/1944 Nyden ..... 222/214
(Continued)

FOREIGN PATENT DOCUMENTS

CA 2141852 A1 2/1994
EP 0481250 A1 9/1991
WO 2009141510 A1 11/2009

OTHER PUBLICATIONS

Canadian Office Action for Canadian Patent App. No. 2,806,575; Sep. 9, 2014; 4 pgs.
(Continued)

*Primary Examiner* — Lien Ngo
(74) *Attorney, Agent, or Firm* — Gardner Groff Greenwald & Villanueva, PC

(57) ABSTRACT

A fluid containment and dispensing system includes a sealed, variable-volume containment device having a movable plunger slidably mounted within a barrel, and a sealing head having a seal insert retained thereon. A seal arrangement includes a self-resealing cross-slit opening, an internal sealing ring for engaging a corresponding coupling of a compatible device, and a raised peripheral seal ring for sealing engagement with a closure lid.

28 Claims, 16 Drawing Sheets

Related U.S. Application Data filed on Sep. 30, 2010, provisional application No. 61/418,961, filed on Dec. 2, 2010.

(51) Int. Cl.
*A61J 9/00* (2006.01)
*B65D 47/08* (2006.01)
*B65D 83/00* (2006.01)
*A61J 9/08* (2006.01)

(52) U.S. Cl.
CPC ..... *B65D 47/2025* (2013.01); *B65D 83/0005* (2013.01); *A61J 9/085* (2013.01)

(58) Field of Classification Search
CPC ..... B65D 47/122; B65D 25/48; B65D 88/64; B65D 35/12; B65D 35/28; A46B 11/0027; B67D 1/0412; B67D 1/0425; A61J 9/005; A61J 9/00; A61J 11/002; A61J 11/001
USPC .... 222/386, 386.5, 387, 394, 395, 396, 397, 222/95, 96, 92, 107, 209, 215, 212, 213, 222/490, 491, 494, 492, 493, 511, 513, 222/517, 528, 529, 532, 531, 533, 534, 222/536, 537, 546, 556, 562, 563, 564; 215/11.5, 11.4, 11.3, 11.1, 311, 310, 307, 215/900; 220/203.19, 203.01, 304, 254.3, 220/378; 604/77, 403
See application file for complete search history.

(56) References Cited

U.S. PATENT DOCUMENTS 2,880,913 A * 4/1959 Peyron ..... 222/214
3,065,873 A 11/1962 Plate
3,067,787 A * 12/1962 Salk ..... B65D 55/02 141/321
3,113,873 A 12/1963 Krause
3,184,120 A * 5/1965 Undi ..... 222/209
3,201,003 A * 8/1965 Wark et al. ..... 222/206
3,521,795 A * 7/1970 Langhjelm et al. ..... 222/386
3,884,396 A * 5/1975 Gordon ..... B05C 17/00516 137/849
3,946,888 A 3/1976 Tonkin
4,010,861 A 3/1977 Welten
4,339,046 A 7/1982 Coen
4,356,935 A * 11/1982 Kamin ..... A47G 19/183 206/384
4,392,851 A 7/1983 Elias
4,493,348 A 1/1985 Lemmons
4,673,396 A 6/1987 Urbaniak
4,685,577 A 8/1987 Chen
4,898,291 A 2/1990 Sailors
5,035,340 A 7/1991 Timmons
5,137,177 A * 8/1992 Willis ..... 222/1
5,170,913 A * 12/1992 Spatz ..... 222/209
5,356,016 A 10/1994 Wiedemann
5,366,115 A 11/1994 Kersten et al.
5,397,313 A * 3/1995 Gross ..... A61M 5/31513 604/218
5,423,791 A 6/1995 Bartlett
5,433,330 A * 7/1995 Yatsko ..... A61J 1/1406 215/247
5,524,783 A 6/1996 Popoff
5,897,033 A * 4/1999 Okawa et al. ..... 222/212
5,988,448 A 11/1999 Foth
6,050,432 A 4/2000 Koehnke
6,371,340 B1 * 4/2002 Pateman et al. ..... 222/494
6,422,415 B1 7/2002 Manganiello
6,465,024 B1 10/2002 Di Scala et al.
6,571,971 B1 * 6/2003 Weiler ..... B65D 1/0238 215/247
6,666,852 B2 12/2003 Niedospial, Jr.
6,672,487 B1 * 1/2004 Lohrman ..... 222/213
6,732,872 B1 5/2004 Gregro et al.
6,832,994 B2 12/2004 Niedospial, Jr. et al.
7,032,764 B2 4/2006 Viggiano
7,255,250 B2 * 8/2007 Pugne ..... 222/556
7,841,581 B2 11/2010 Thorne, Jr. et al.
2002/0088827 A1 7/2002 Colucci
2004/0251278 A1 * 12/2004 Arai ..... B65D 47/2031 222/212
2007/0023462 A1 * 2/2007 Pugne ..... 222/556
2007/0029352 A1 * 2/2007 Norris et al. ..... 222/494
2008/0237271 A1 * 10/2008 Olechowski ..... 222/494
2009/0204097 A1 8/2009 Knight
2010/0022984 A1 1/2010 Knight
2010/0204669 A1 8/2010 Knight
2011/0054436 A1 3/2011 Griffis, III et al.

OTHER PUBLICATIONS

International Search Report and Written Opinion for PCT/US2011/045481; Jan. 4, 2012; 19 pgs.

* cited by examiner

FLUID CONTAINMENT AND DISPENSING SYSTEM

CROSS-REFERENCE TO RELATED APPLICATIONS

This application claims the priority benefit of U.S. Provisional Patent Application Ser. No. 61/368,023, filed Jul. 27, 2010, U.S. Provisional Patent Application Ser. No. 61/388,057, filed Sep. 30, 2010 and U.S. Provisional Patent Application Ser. No. 61/418,961, filed Dec. 2, 2010, which are hereby incorporated herein by reference in their entireties.

TECHNICAL FIELD

The present invention relates generally to the field of containment and dispensing of fluids, and more particularly to a containment and dispensing system for biological fluids, such as breast milk and/or dietary or medicinal materials.

BACKGROUND OF THE INVENTION

Maintaining aseptic integrity is of great importance in many fluid containment and dispensing applications. For example, in the delivery of breast milk or formula to premature infants who are unable to feed regularly, freshness and prevention of contamination are critical. The delivery of enteral fluids is often controlled by regulations and medical standards of practice.

In addition to proper containment and dispensing of biological fluids such as breast milk or formula, it is also desirable to provide for the containment, mixing and delivery of pharmaceutical or nutritional supplements. Various consumer and/or professional applications would benefit from improved systems and methods for fluid containment and delivery.

It is to the provision of improved systems and methods for fluid containment and delivery that the present invention is primarily directed.

SUMMARY OF THE INVENTION

The present invention provides a variable-volume, sealed containment and delivery system for use with breast milk, formula, or other fluids. The system is preferably adaptable for home/consumer use, as well as hospital/professional applications. In example embodiments, the system of the present invention includes a primary containment device having a movable plunger defining a variable volume within a containment barrel or chamber, and a multi-seal closure member for maintaining freshness and aseptic conditions. Optionally, one or more secondary containment devices are interchangeably associated with the primary containment device, and/or one or more interchangeable dispensing heads or port configurations are provided.

In one aspect, the invention relates to a fluid containment and dispensing system for containing and/or dispensing fluid while maintaining the fluid fresh and aseptic and protecting against contamination. The system includes a variable-volume primary container defining an interior volume having a bore and having a movable plunger slidably mounted within the bore so as to vary the contained volume of the primary container as the movable plunger slides within the bore. The system also includes a closure fitted to the variable-volume primary container, and the closure comprises a substantially rigid cap for capping the variable-volume primary container and a cover for covering the cap. A flexible seal insert is retained at the closure and comprises an outer seal panel and an inner seal ring spaced from the outer seal panel, the outer seal panel being perforated by a slit to provide selected access to the inner seal ring as desired, while protecting the inner seal ring against the elements.

Optionally, with the cover covering the cap the outer seal panel seals against an underside surface of the cap. Also optionally, the cover can be provided with concentric sealing ridges for engaging the outer seal panel.

Moreover, the slit can comprise a resealable cross-slit. Also, the cover can be hingedly coupled to the and/or detachably coupled to the cap.

The cap can include a substantially cylindrical port and the flexible seal insert can include a first sealing surface for sealing against an outside annular portion of the cylindrical port, a second sealing surface for sealing against a middle cylindrical portion of the port, and a third sealing surface for sealing against an inside annular portion of the cylindrical port.

The inner seal ring of the flexible seal insert can be located adjacent and interiorally of the second sealing surface of the flexible seal insert.

Optionally, with the cover uncovering the cap, an attachment can be fitted to closure, and the attachment can include a tubular element extending through the flexible seal insert for accessing the variable-volume primary container. The attachment can include an optional fluid-dispensing nipple for permitting an infant to suckle fluid contained within the variable-volume primary container.

Preferably, the attachment can include a secondary fluid container for transferring fluid to and/or from the variable-volume primary container and the secondary fluid container for transferring fluid to and/or from the variable-volume primary container can include a movable plunger. Optionally, the attachment can include a fluid dispensing nipple with a fluid line extending therefrom for transferring fluid to and/or from the variable-volume primary container.

Optionally, the movable plunger can be provided with gaskets, for example two spaced-apart pairs of rounded seal contact faces in sliding abutment with an interior surface of the bore.

Preferably, the seal insert comprises an internal sealing ring projecting inwardly from an interior wall thereof. Also, the internal sealing ring can be configured to couple with an enteral-only male connector.

Moreover, the fluid containment and dispensing system can be provided with a secondary container having a coupling adapted for sealing engagement with the flexible seal insert.

Optionally, a plurality of interchangeable sealing head configurations can be used with the fluid containment and dispensing system.

Preferably, the seal insert is configured for coupling to an enteral-only fitting and can be adapted to receive a tubular element therethrough for accessing the variable-volume primary container.

In another aspect, the present invention relates to a fluid containment and dispensing system including a sealed, variable-volume primary containment device having a movable plunger slidably mounted within a barrel, and a sealing head having a seal insert retained thereon.

In another aspect, the invention relates to a seal assembly for a fluid containment and dispensing system. The seal assembly preferably includes a sealing panel having a slit access port formed therein, and defines a fluid conduit extending therethrough. The seal assembly also includes an internal sealing ring projecting into the fluid conduit, the internal sealing ring spaced at a depth from the sealing panel and defining an inner diameter, wherein the depth and the inner diameter are configured to sealingly engage a corresponding coupling.

In another aspect, the invention relates to a container including a flexible containment portion a resealable closure for input and/or removal of a fluid to and from a sealed, collapsable interior contained space within the flexible containment portion.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
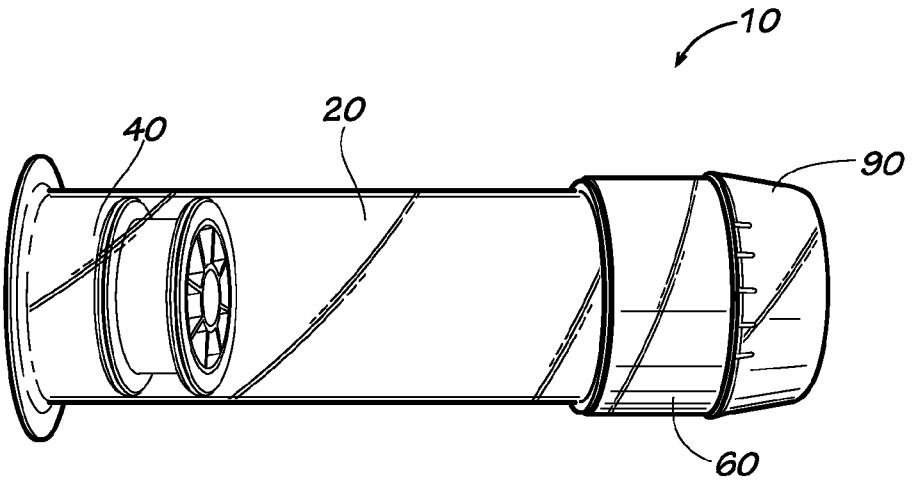
FIG. 1 is a perspective view of a fluid containment and dispensing system according to an example embodiment of the present invention.
Figure 2:
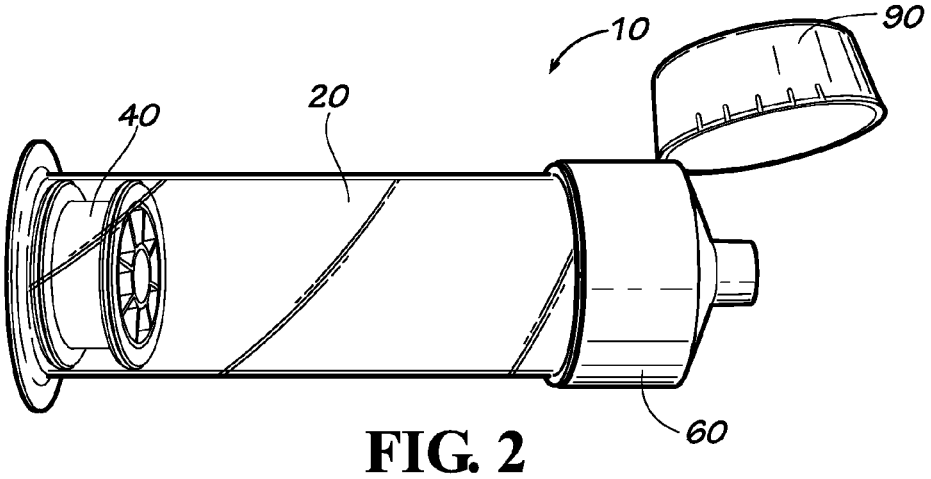
FIG. 2 shows the containment and dispensing system of FIG. 1, with a closure cap in its open position, and a plunger in a retracted position.
Figure 3:
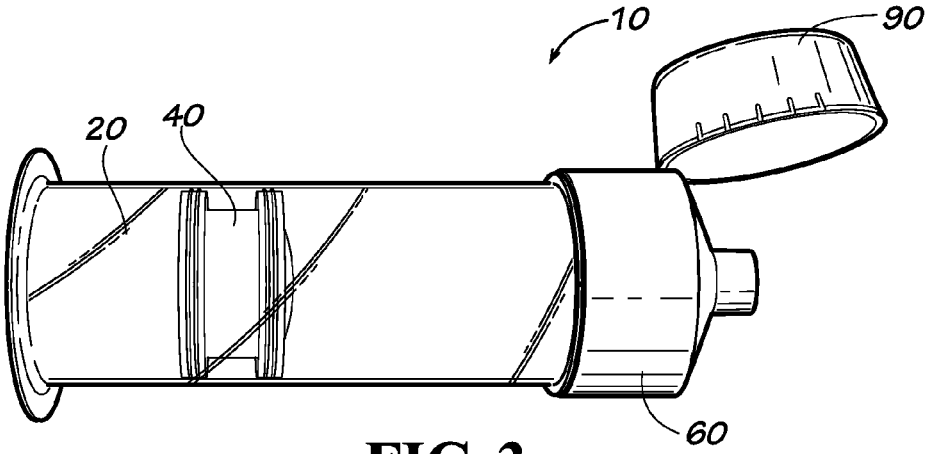
FIG. 3 shows the containment and dispensing system of FIG. 1, with the plunger in a partially advanced position.
Figure 4:
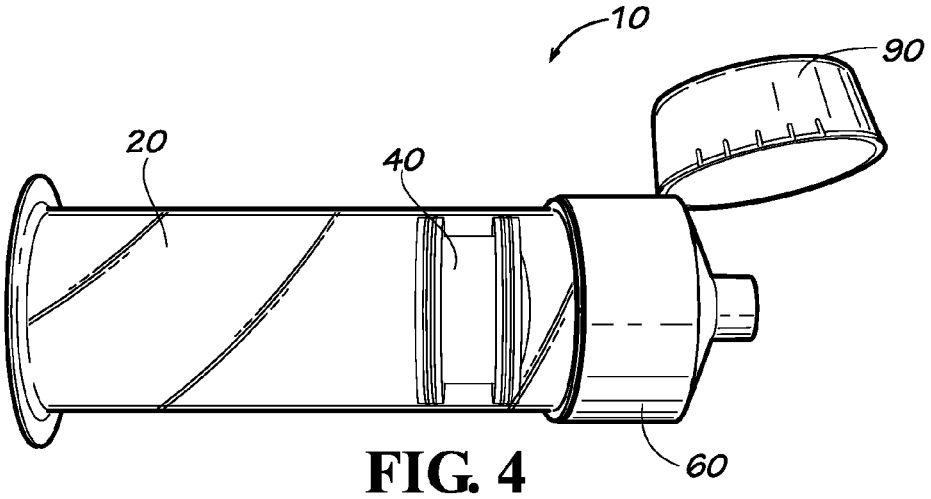
FIG. 4 shows the containment and dispensing system of FIG. 1, with the plunger in an advanced position.
Figure 5:
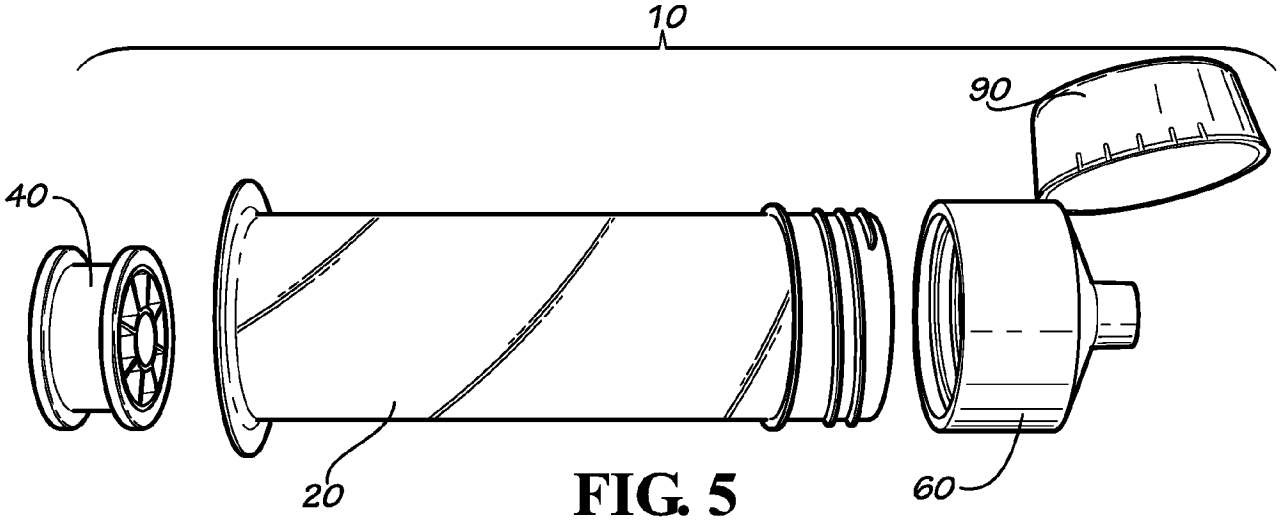
FIG. 5 is an exploded view of the containment and dispensing system of FIG. 1.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-5 show a fluid containment and dispensing system according to an example form of the invention. The fluid containment and dispensing system comprises a primary containment device or container 10 including a hollow, generally cylindrical containment barrel 20, a movable plunger 40, a dispensing and sealing head 60, and a closure cap 90.

Figure 14A:
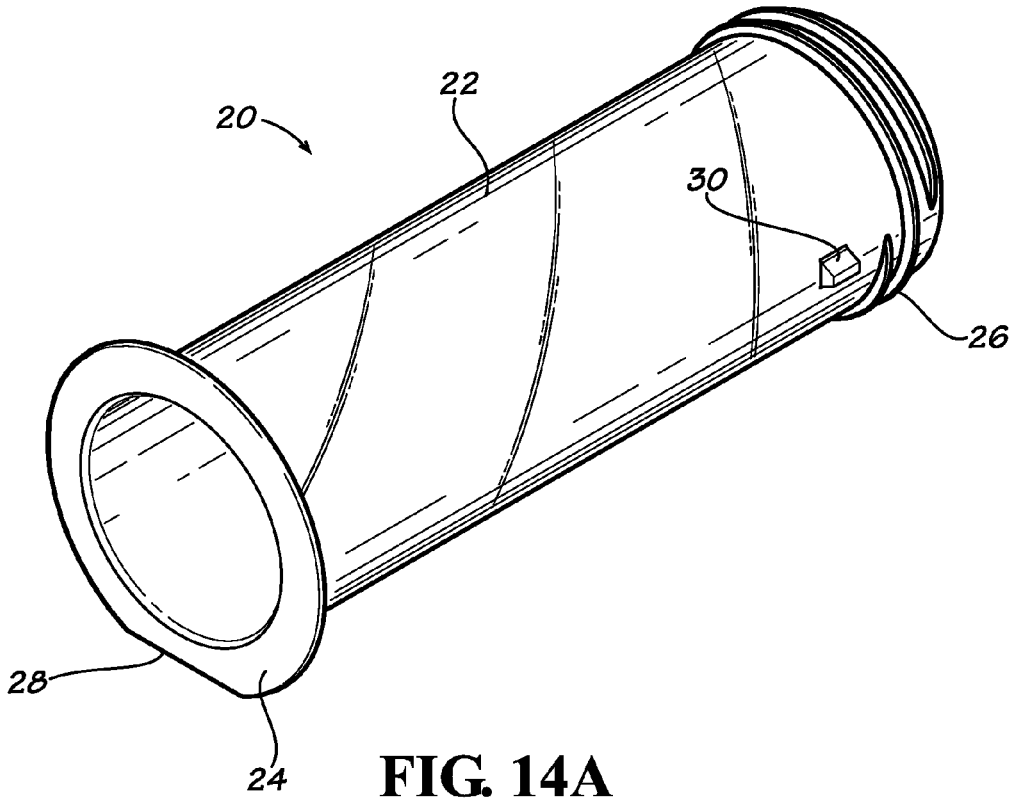
FIGS. 14A and 14B are perspective and sectional views, respectively, of the containment barrel component of the containment and dispensing system of FIG. 1.
Figure 14B:
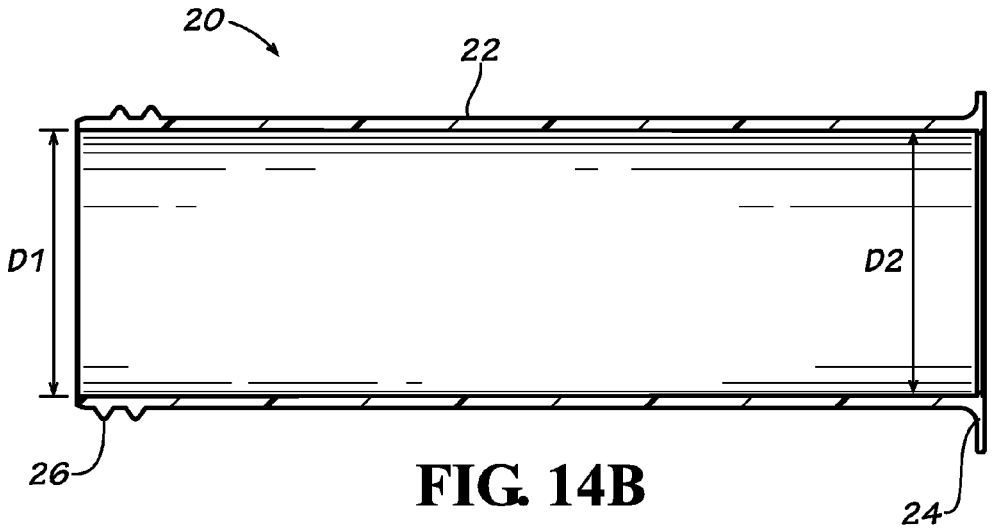
Figure 15A:
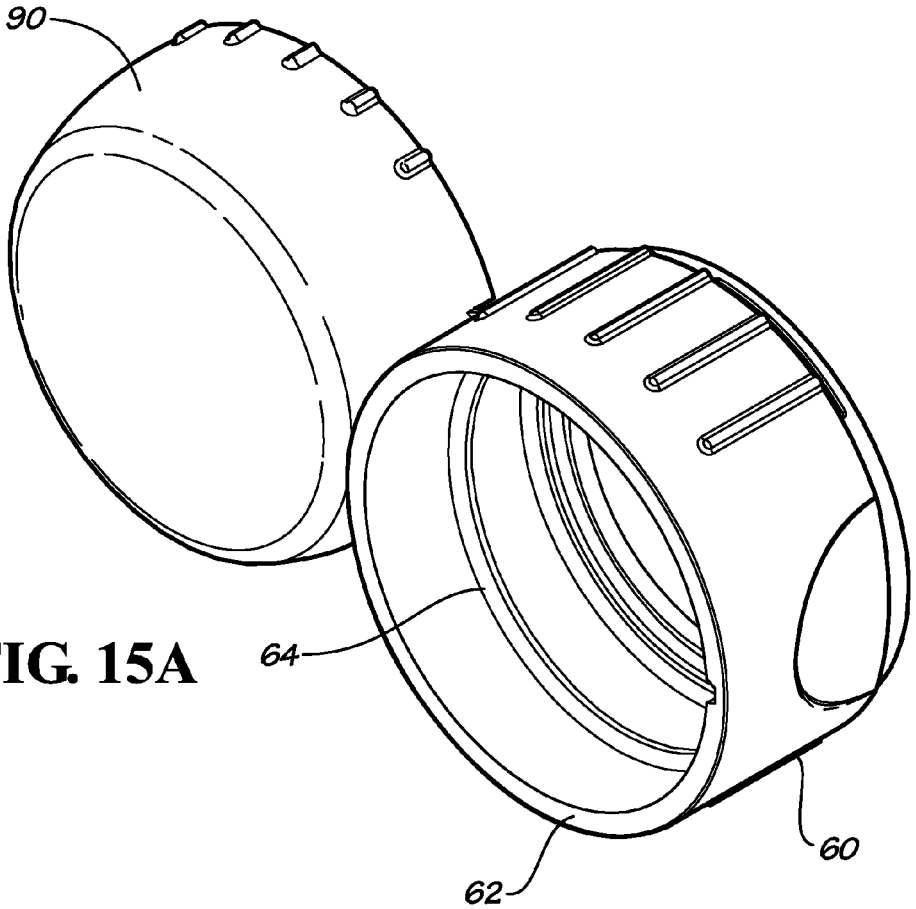
FIGS. 15A and 15B are perspective and sectional views, respectively, of the of the closure cap and head component of the containment and dispensing system of FIG. 1.
Figure 15B:
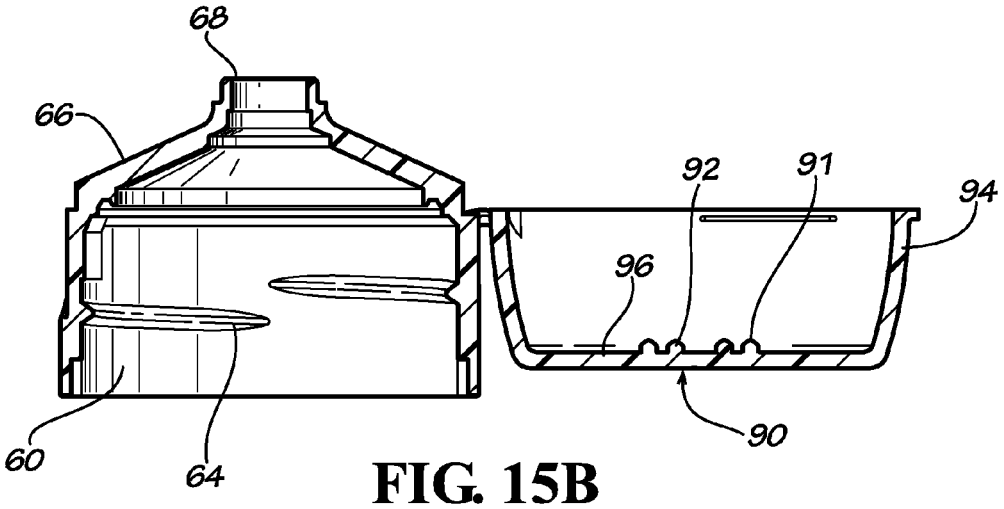

The containment barrel 20 is shown in greater detail in FIGS. 14A, 14B, and comprises a body portion or sleeve 22 defining an interior chamber for containment of the fluid with which the device is to be used, and having circular openings at each end thereof. The length and diameter of the interior chamber may vary depending on the desired application, to provide adequate fluid volume. The containment barrel 20 further comprises a base flange 24 at a first end of the sleeve 22, and a threaded second end 26 opposite the base flange. The base flange optionally comprises a flat portion 28 to prevent rolling when the device 10 is placed on a flat surface. A cap connection indicator 30 is optionally provided along the sleeve 22 adjacent the threaded second end 26. The sleeve 22 is preferably slightly tapered from a greater inside diameter $D_1$ at the second end 26 to a lesser inside diameter $D_2$ at the base end 24 to facilitate de-molding during manufacture.

Figure 6:
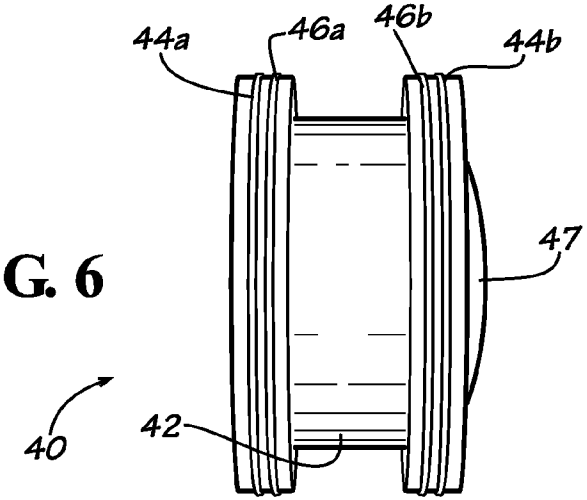
FIG. 6 is a detailed side view of a plunger component of the containment and dispensing system of FIG. 1.
Figure 7:
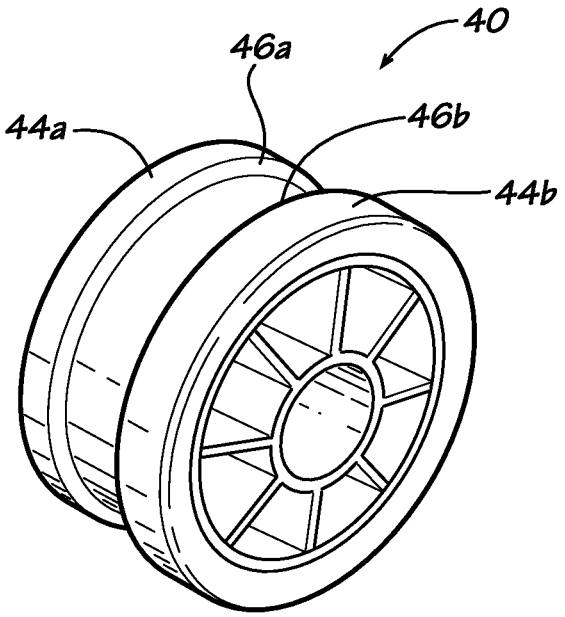
FIG. 7 is a detailed front perspective view of the plunger component.
Figure 8:
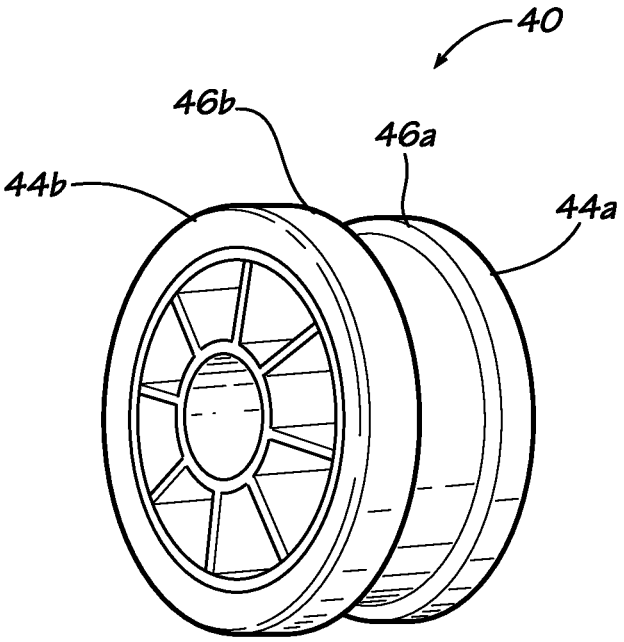
FIG. 8 is a detailed rear perspective view of the plunger component.
Figure 17A:
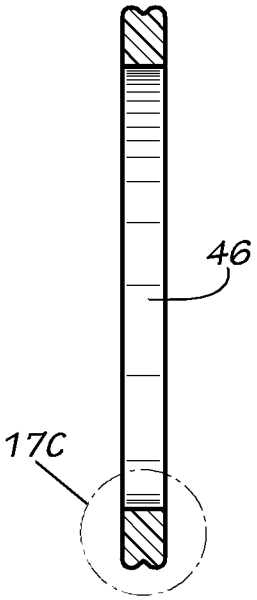
FIGS. 17A-17C side, top, and sectional views, respectively, of a gasket component of the plunger of the containment and dispensing system of FIG. 1.
Figure 17B:
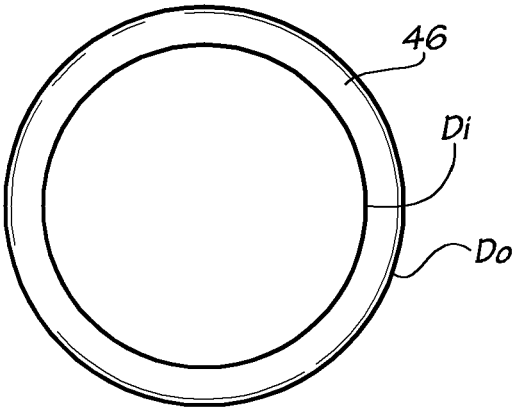
Figure 17C:
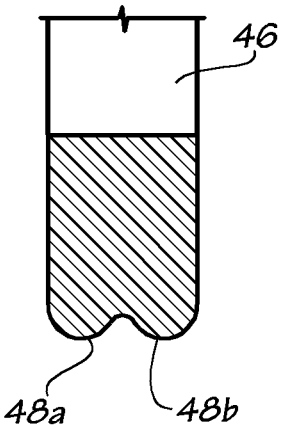

The movable plunger 40 is shown in greater detail in FIGS. 6-8, and comprises a generally cylindrical body portion 42 having a pair of spaced-apart circumferential channels 44*a*, 44*b* for receiving gaskets 46*a*, 46*b*. FIGS. 17A-17C show greater detail of the gasket 46, which comprises an annular band or ring having an inside diameter $D_i$ and an outside diameter $D_o$. The gaskets 46 are fabricated from a resilient material providing a good seal and a low coefficient of friction with the interior surface of the sleeve 22 of the containment barrel 20, such as for example a silicone rubber elastomer. In an example embodiment, the gaskets and seal comprise a blend of about 66.7% 35D silicon (Dow C6-135, Pur C, by Dow Corning Co.), and about 33.3% 65D Silicon (Dow C6-165 Pur C). In alternate embodiments, the gaskets and seal comprise Santoprene 181 and/or Santoprene 8281, and/or other flexible elastomer(s). The inner diameter $D_i$ of the gaskets 46 is preferably about equal to or slightly smaller than the diameter of the channels 44 of the plunger, thereby providing secure retention of the gaskets on the plunger. The outer diameter $D_o$ of the gaskets 46 when installed in tension onto the plunger 40 is preferably slightly greater than the greater inside diameter $D_1$ of the sleeve 22, such that flexure and compression of the gasket allows the plunger to slide smoothly in continuous sealing contact along the length of the sleeve. The respective outer and inner diameters of the movable plunger and the barrel 20 preferably allow insertion and removal of the plunger from either open end of the barrel. Optionally, the rear end of the barrel comprises a slight inward projection or tab to prevent unintentional removal of the plunger therefrom. The outer contact face of the gaskets 46 preferably comprise a bicuspid profile defining two radiused or ribs or circumferential contact fins 48. In this manner, the plunger 40 provides two spaced pairs (four total) of rounded seal contact faces in sliding abutment with the interior of the sleeve 22.

The material selection can be chosen to make the containment system suitable for contact/storage/dispensing/mixing of components that may be liquid, solid (powdered nutritional supplements or formula), suspensions (some medications etc). Moreover, the variable volume feature can be advantageous where freezing may cause a volume increase of the components stored therein. Furthermore, it is believed that the variable volume can allow for pressure changes to be neutralized resulting from any volume change (as by temperature changes or freezing) and may provide a strong indicator of boiling with a rapid increase in volume. The variable volume aspect of the invention helps to maintain proper seal integrity in the face of internal pressure changes.

Figure 11:
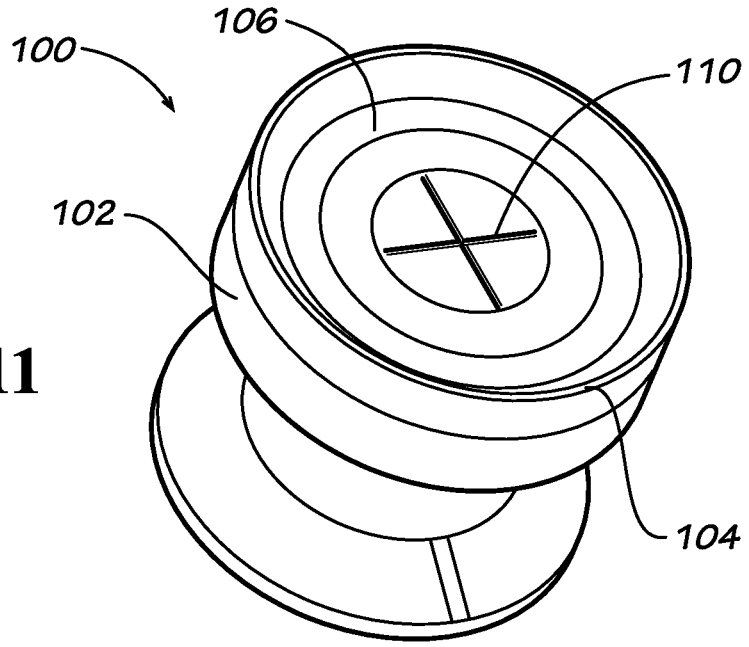
FIGS. 11 and 12 show the seal component in greater detail.
Figure 12:
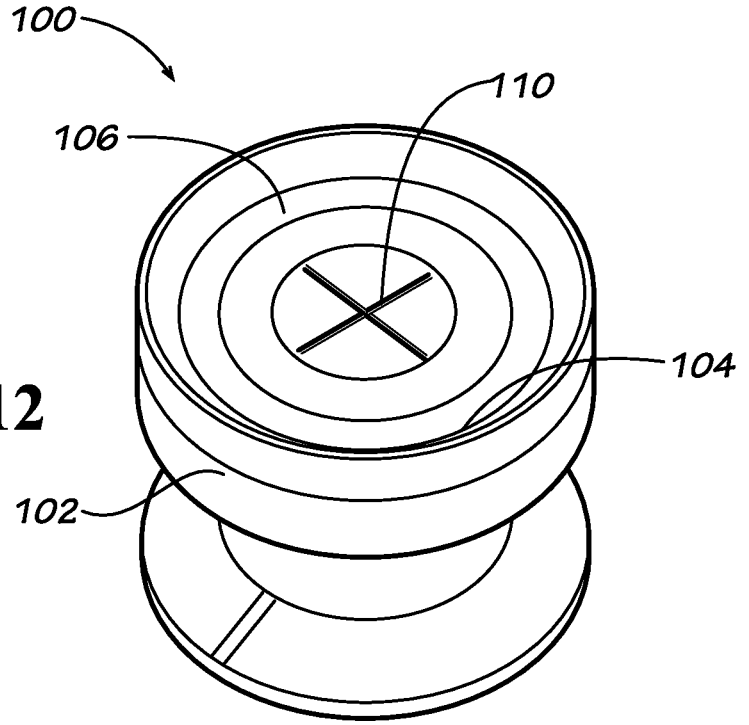
Figure 16A:
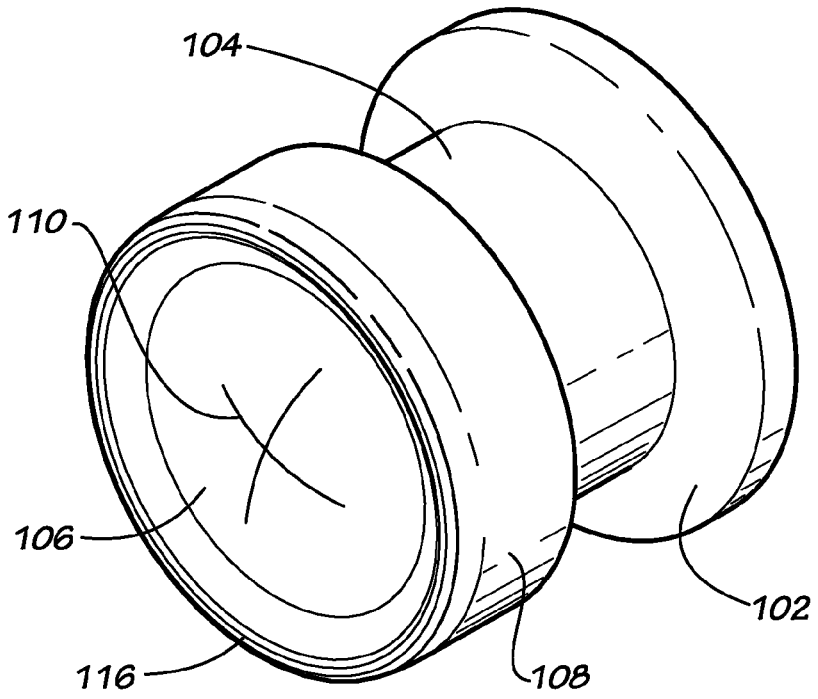
FIGS. 16A and 16B are perspective and sectional views, respectively, of the of the seal component of the containment and dispensing system of FIG. 1.
Figure 16B:
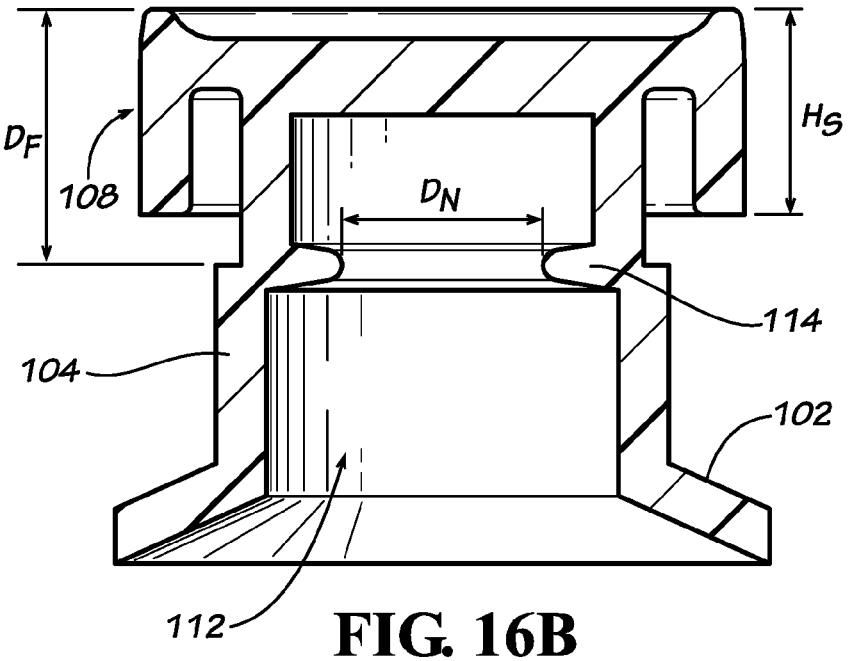

The sealing head 60 and closure cap 90 are shown in greater detail in FIGS. 9, 10 and 15A, 15B. The sealing head 60 comprises a cylindrical mounting flange 62 having internal threads 64 configured to engage the threaded end 26 of the containment barrel 20 to couple the sealing head to the barrel. The sealing head 60 further comprises a conical transition portion 66 extending from the mounting flange 62 at an angle of inclination of about 24° to reduce bubble accumulation, and terminating in a nipple or nozzle 68. An internal chamfer profile 70 is provided within the interior of the transition portion 66 and nozzle 68 to receive and engage cooperating profile elements of an elastomeric seal insert 100, shown in greater detail in FIGS. 11, 12 and 16. The closure cap 90 is pivotally connected to the cylindrical mounting flange 62 by an integral hinge 92, and comprises a circumferential rim or collar 94 extending from a circular lid panel 96. The closure cap 90 is thereby movable between a closed configuration (see FIG. 1) covering the nozzle 68 and seal 100, and an open configuration (see FIG. 2) exposing and allowing access to the nozzle and seal area. Optionally, a sealing gasket can be provided in the underside of the sealing head 60 to seal against the end of the barrel 20 to provide a more positive seal thereat. Optionally, the plunger can be provided with a convex forward surface or face, as shown in FIG. 6, to facilitate more complete evacuation of fluid from the barrel 20 as the plunger 40 is moved toward the sealing head 60. While the convex face 47 is shown in this figure as fairly shallow, it can be more pronounced to extend farther into the underside of the sealing head 60. Indeed, the convex face 47 can be configured to closely match the underside profile of the sealing head 60 so as to effect near complete evacuation of the containment device as the plunger 40 is moved to its limit up against the sealing head 60.

Figure 9:
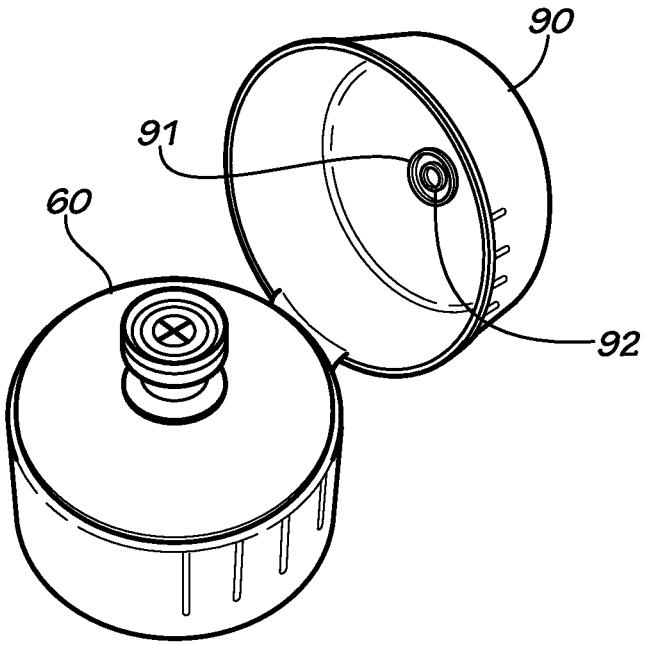
FIG. 9 is a detailed view of a dispensing head component of the containment and dispensing system of FIG. 1.
Figure 10:
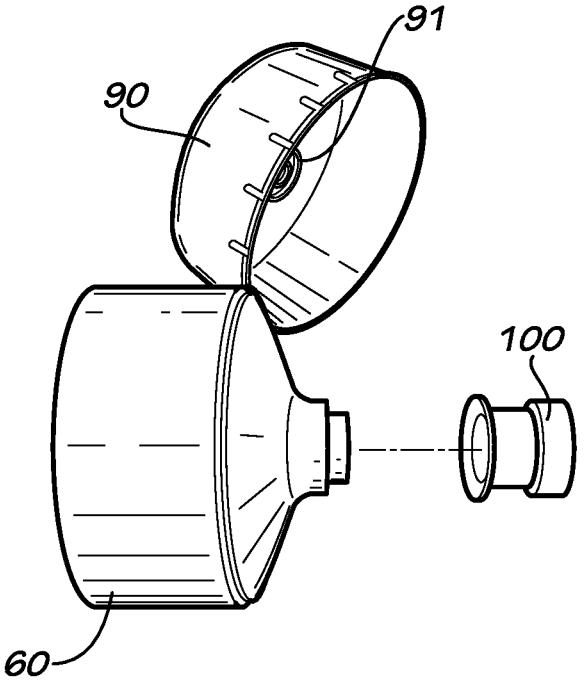
FIG. 10 is an exploded view of the dispensing head with a seal component separated therefrom.

As shown in FIGS. 9 and 10, the closure cap 90 is provided with concentric ridges 91, 92, having the appearance much like a "bulls-eye" to provide a more positive seal with the seal insert 100. With the closure cap closed against the sealing head 60, the ridges 91, 92 formed in the underside of the closure cap are brought into sealing engagement with the top surface of the seal insert 100 to provide a more positive seal against the elements. See FIG. 16C. In this regard, the concentricity of the ridges provides extra protection by providing successive barriers against intrusion. In addition to sealing against elements when the outer seal panel is against the underside of the closure cap, the outer seal also generally prevents spillage should the containment system be inverted or tilted with the lid open.

The elastomeric seal insert 100 comprises an outwardly projecting lower retainer flange 102 and an inwardly recessed neck portion 104 for engagement within the internal chamfer profile 70 of the sealing head 60, and an external sealing panel 106 having a collar 108 for attachment over the nozzle 68 of the sealing head. A pair of slits form a cross-shaped, self-sealing access port 110 through the sealing panel 106. The seal insert 100 defines a fluid conduit 112 extending therethrough, providing fluid communication between the self-sealing access port 110 and the interior chamber of the containment barrel 20 when the device is assembled. An internal sealing ring 114 projects inwardly from the interior wall of the seal insert into the fluid conduit, spaced at a depth $D_F$ from the sealing panel 106. The inner diameter $D_N$ of the sealing ring 114 and the depth $D_F$ correspond to the nipple diameter and length, respectively, of a standard enteral male connector (unshown) such that the tip of the male connector is sealingly engaged within the sealing ring when a secondary containment device is coupled to the device 10. Also, the height $H_S$ of the external sealing panel 106 is selected to correspond to the depth of the circumferential rim or collar 94 such that the underside of the circular lid panel 96 sealingly contacts a raised external seal ring 116 about the periphery of the external sealing panel when the closure cap 90 is closed.

Optionally, the seal insert can be initially provided with a removable foil seal thereover. This removable foil seal can be called for in certain applications, such as medicines/pharmaceuticals and prepackaged applications, such as ready-to-dispense formula, ready-to-dispense saline, etc.

Figure 13:
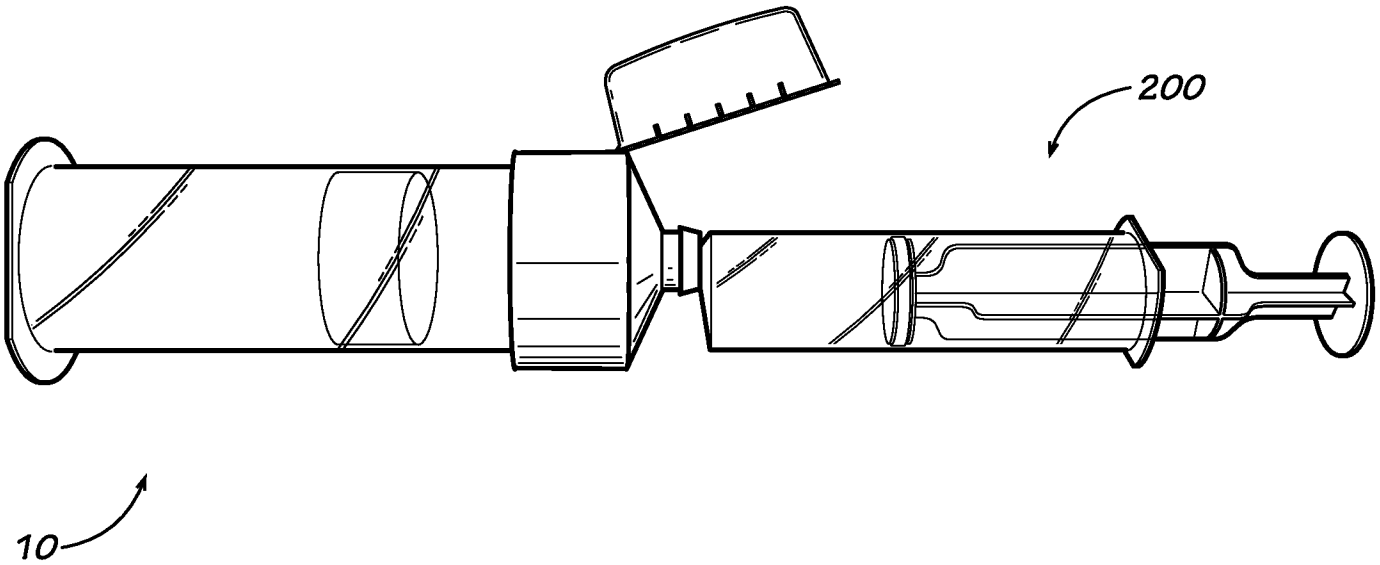
FIG. 13 shows a fluid containment and dispensing system including the primary containment device shown in FIG. 1, in combination with a secondary containment device.
Figure 16C:
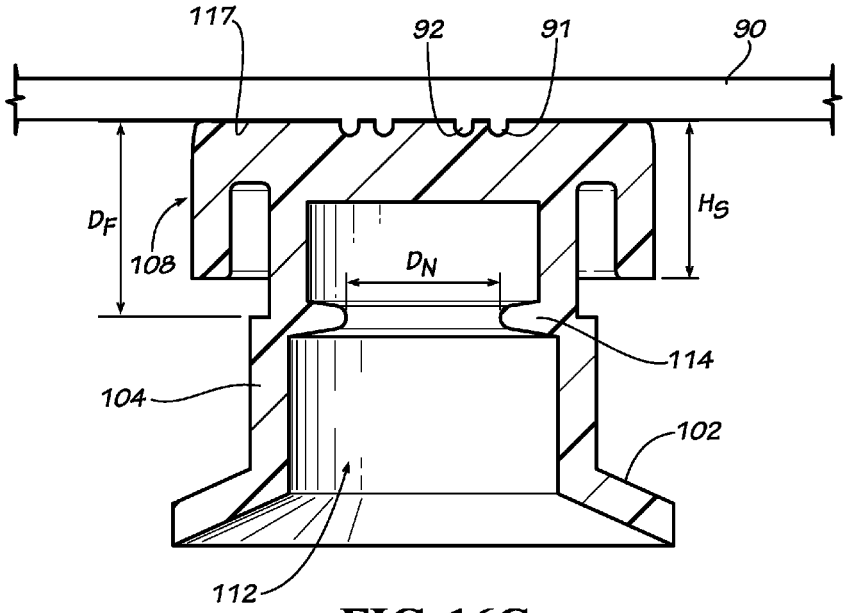
FIG. 16C is a sectional view of the of the seal component of the containment and dispensing system of FIG. 1, in a modified form.

FIG. 13 shows a secondary containment device or container 200 coupled to the primary containment device 10. In the depicted embodiment, the secondary containment device comprises an enteral syringe, but in alternate embodiments can take various forms, including an enteral feeding tube, a breast pump coupling, a feeding nipple, an IV delivery coupling, a container of medication or nutritional supplement, or other container or delivery device. The secondary containment device 200 comprises a nipple or other delivery coupling for engagement within the seal insert 100 of the primary containment device. In the depicted embodiment, the seal insert 100 carries out three independent sealing functions: (1) the cross-slit self-sealing access port 110 seals out contaminants, seals in the contained fluid, and engages the delivery coupling of the secondary containment device; (2) the internal sealing ring 114 forms a seal about the delivery coupling of the secondary containment device to prevent leakage and pooling of fluid; and (3) the raised external seal ring 116 seals against the underside of the lid panel 96 of the closure cap 90 to prevent leakage and pooling. As shown in FIG. 16C, the raised external seal ring 116 can be dispensed with and instead the distal face 117 of the seal insert can be substantially flat for engaging the concentric ridges 91, 92 of the closure cap 90.

The connection and sealing engagement of the syringe of the secondary containment device 200 to the primary containment device 10 enables the transfer of fluid between the devices. For example, a quantity of medication or nutritional supplement may be delivered from the syringe to breast milk or formula contained within the primary containment device. Likewise, a quantity of breast milk or formula can be withdrawn from the primary containment device into the syringe for a single feeding, allowing the primary containment device to deliver multiple feedings and maintain a hermetic seal to ensure freshness and aseptic delivery. Optionally, the coupling elements of the primary and/or secondary containment devices can be content-specific or application specific, to prevent inadvertent misuse. For example, the seal coupling 100 of the primary containment device may be configured to engage enteral-only connectors, but to prevent use with vascular or intravenous Luer connectors, to prevent inadvertent connection of an IV solution to enteral delivery devices and/or to prevent connection of an enteral solution to an IV delivery device.

The containment and dispensing system of the present invention can comprise the primary containment device 10 alone, or in combination with one or more like or different secondary containment device(s), which can be utilized along or interchangeably in connection with the overall system. The primary containment device 10 and/or the secondary containment device(s) 200 are optionally marked, as by silk screening, imprinting or molding, with volume level indicators, unique identifiers such as bar coding or the like, manufacturing information, branding, contents information, use restrictions, and/or other indicia. Color-coding of the containment devices of the system is optionally provided, for example with orange or purple marking. The devices optionally incorporate UV or other spectral absorbing tinting, for example an amber colorant, in their materials of construction, to resist degradation of their contents by ambient light. In example forms, the barrel, cap and plunger, exclusive of seal and gasket components may comprise a medical or food grade Class VI polypropylene or other inert polymeric material compatible for use with enteric or medical applications, and which resists damage from heating and freezing.

The primary containment device 10 thereby provides an airtight and watertight hermetically sealed enclosure, having a variable volume to minimize exposure of the contents to air. The plunger of the device advances and retracts within the barrel upon application of suction or positive pressure by a syringe coupled thereto, to reduce or increase the device's contained volume. The device optionally comprises one or more special configurable ports allowing connection to various secondary containment devices. The port(s) and/or the bottom opening of the barrel are optionally initially sealed by a removable foil, plastic film or paper cover to prevent contamination prior to use. Optionally, the device is self venting.

The containment and dispensing system of the present invention can be adapted for various fluid containment and delivery applications. For example, in the containment and delivery of breast milk, formula or other fluids for enteral nutrition, the containment devices preferably comprise enteral-only access ports, which allow fluid to flow in and out of the containers. Optionally, the sealing head is removable and resealable, and allows interchangeable use with various alternate fluid transfer and/or closure head configurations. For example, the threads of the sealing head and barrel are optionally configured for compatibility with standard breast pump container couplings. A fluid transfer head having a feeding nipple can be interchangeably mounted in place of the sealing head for direct feeding from the container. Optionally, a non-vented feeding nipple attachment is provided. The device optionally allows multiple feedings from a single contained volume, while maintaining freshness of the contents. A positive indicator, such as a visible marking, audible or tactile snap coupling, or other indication means is optionally provided on the sealing head or other closure to confirm lid closure. The device can be configured for home or hospital use, and/or with sterile or non-sterile delivery options.

In alternate forms, the containment devices of the present invention are adapted to various other special applications, such as pharmaceutical or bulk fluid delivery, oral fluid delivery, intravenous (IV) fluid delivery, and/or various other medical or non-medical fluid containment and delivery applications. A pre-mix of medication(s) (IV or oral), enteral nutritional supplements or formula may be provided therein. A variety of port configurations may be provided, for example enteral-only, IV, Luer-slip, Luer-lock, reverse-Luer, self-venting, and/or other ports or couplings. A locking lid is optionally provided to prevent tampering or inadvertent misuse.

In multiple dose vial applications, a variety of port configurations are optionally provided to allow multiple dose withdrawals from a single container. For example, the ports may be two-way allowing inflow and outflow, or may function as one-way directional check-valves allowing only outflow from the contained volume and preventing potential contamination from fluid inflow. The ports optionally incorporate a unique or proprietary specialized and/or function-specific geometry or design to prevent use with incompatible components. The container can be delivered prefilled or empty, and optionally comprises a saline flush port. Optionally the lid is self-locking and cannot be re-opened after initial closure.

Figure 18:
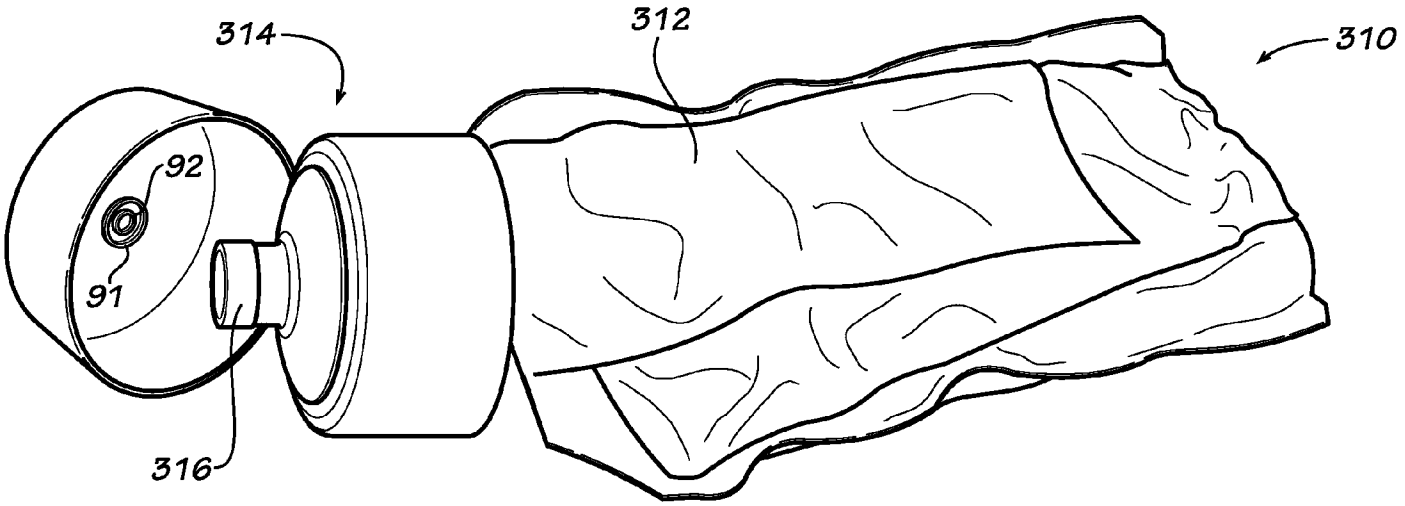
FIG. 18 shows a containment and dispensing system having a flexible containment portion, according to another example embodiment of the present invention.
Figure 19:
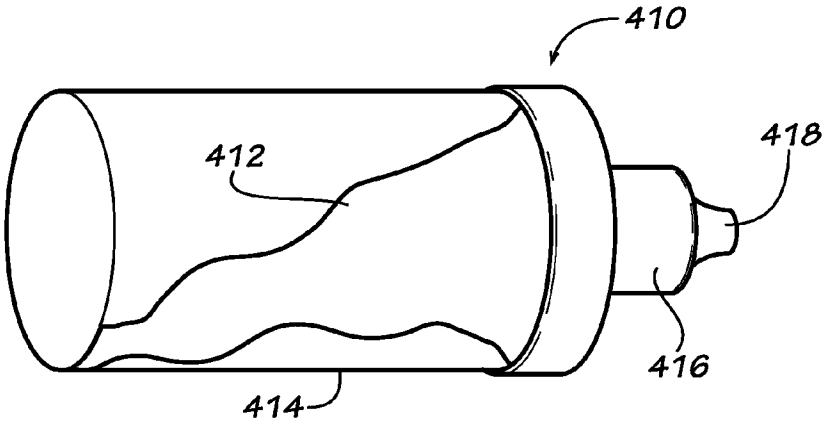
FIG. 19 shows a containment and dispensing system having a flexible containment portion within a rigid outer container shell, according to another example embodiment of the present invention.
Figure 20A:
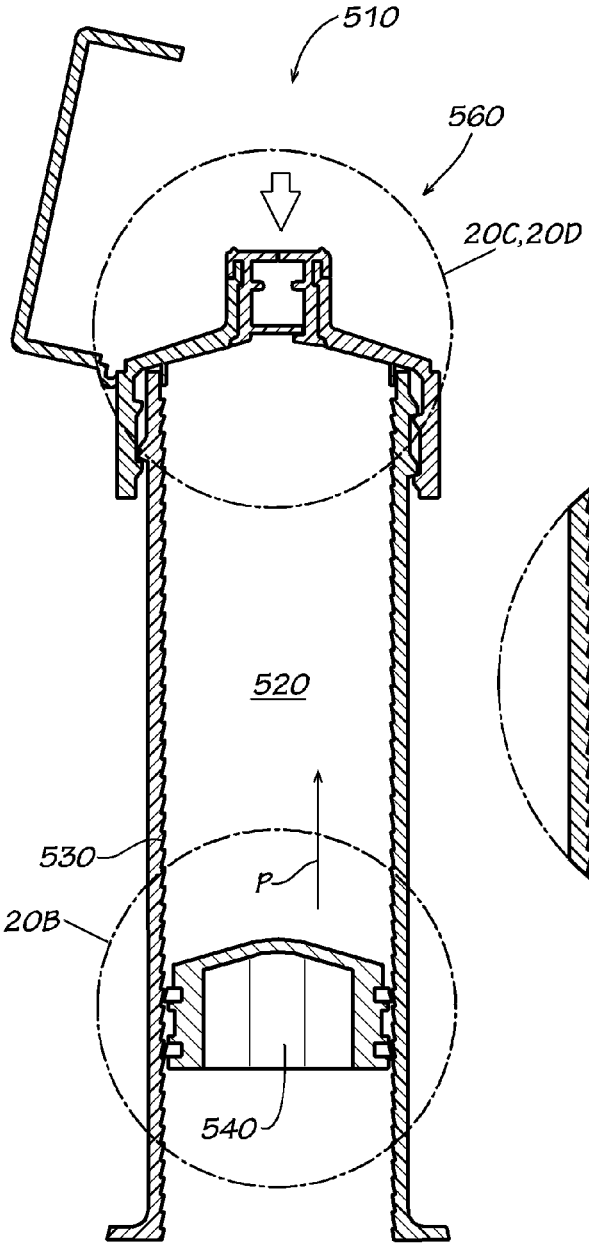
FIGS. 20A-20D show a containment and dispensing system having one-way flow control, according to another example embodiment of the present invention.
Figure 20B:
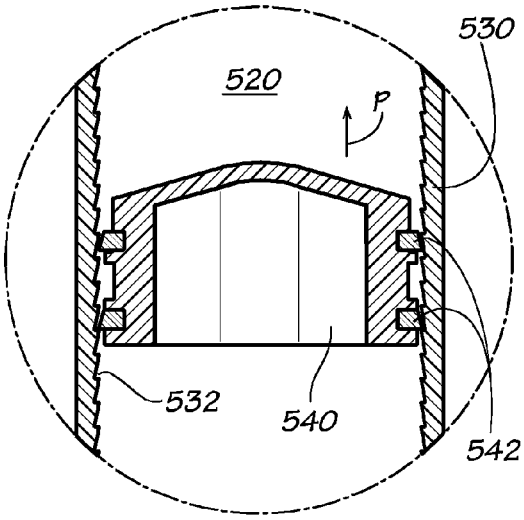
Figure 20C:
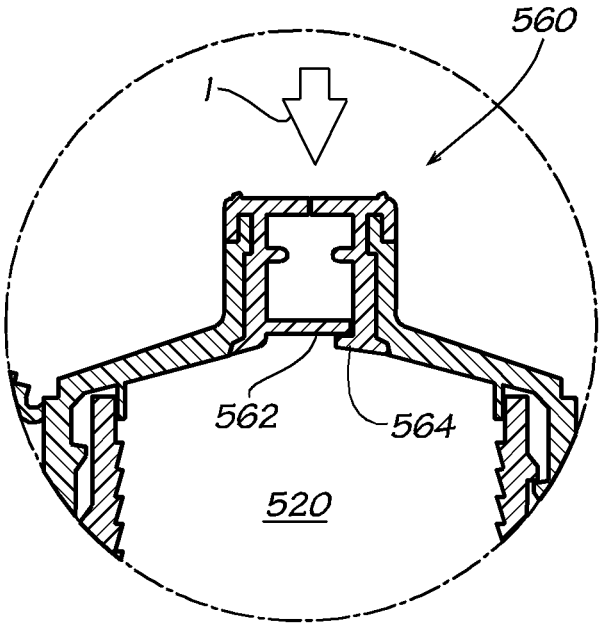
Figure 20D:
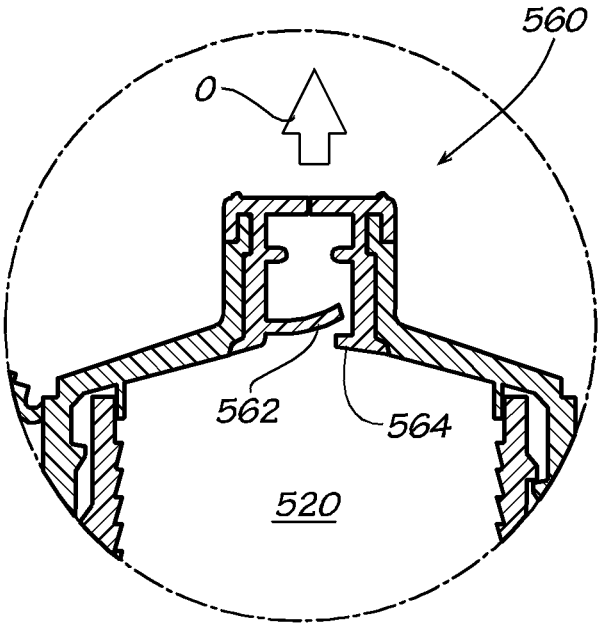

FIG. 18 shows another embodiment of a fluid containment and dispensing system 310 according to the invention. A flexible containment portion 312, such as a flexible aluminized pouch, a plastic bag insert, a flexible polymeric bottle, a metallic foil tube, Mylar pouch, or the like, encloses a hermetically sealed interior contained space for receiving a fluid such as breast milk, formula, medication or other fluid. A cap 314 includes a resealable enteral valve, luer connector, or other resealable closure or port 316 for receiving and/or discharging fluid to and from the interior contained space. The cap 314 can be integrally formed with the flexible containment portion 312, or can be attached thereto by means of a polypropylene or polyethylene throat, insert molding, threaded coupling, snap fitting, RF welded, adhesively, and/or otherwise secured to the flexible containment portion. FIG. 19 shows another embodiment of a fluid containment and dispensing system 410 according to the invention. A flexible containment portion 412, for example similar to that described above, is secured within a rigid or semi-rigid outer container shell 414, having a cap 416 comprising a resealable closure 418 mounted thereto. The provision of a flexible containment portion allows the contained volume to collapse as fluid is withdrawn, and expand as fluid is introduced, eliminating the need for venting of the contained volume and reducing or eliminating the exposure of the contained fluid to air or external contamination. Optionally, the resealable port is initially sealed within an extended segment of the flexible containment portion to prevent contamination, and the extended segment can be detached or reclosably opened for access to the port. Also optionally, the flexible containment portion can be initially filled with fluid via a secondary port that is permanently sealed closed after filling, and the resealable port subsequently used for removal and/or refilling.

FIGS. 20A-20D show a further embodiment of a fluid containment and dispensing system 510 having one-way flow control to allow flow of fluid or other material out of the containment chamber 520, and/or prevent flow into the containment chamber. In the depicted embodiment, two one-way flow control mechanisms are provided. In alternate embodiments, either or both types of flow control mechanisms, and/or other flow control mechanisms may be utilized, alone or in combination. The internal surface of at least a portion of the barrel 530 comprises a series of inclined or ramped teeth or ridges 532, each tooth having an acutely angled first inclined face directed toward the distal end of the barrel and a transversely angled shoulder directed toward the proximal end of the barrel. The plunger 540 comprises one or more (two are shown) resilient gaskets or sealing members 542, such as for example silicone or rubber o-rings or bushings, having an inclined outer circumferential face having an angle of inclination generally corresponding to the acutely angled face of the barrel ridges and a transverse distal face. The ratcheting interaction between the angled surfaces of the sealing members 542 and the inclined ridges of the barrel 530 permit the plunger 540 to move with little resistance in a first direction toward the proximal end of the barrel (in the direction indicated by arrow P), but to substantially resist movement of the plunger in a second direction toward the distal end of the barrel. Movement of the plunger in the first direction drives discharge of contained fluid from the contained volume 520 through the discharge nozzle 560, while resistance to movement of the plunger in the second direction prevents inflow of fluid into the contained volume. A second one-way flow control mechanism is provided in the form of a unidirectional flexible flap 562 adjacent the discharge nozzle 560. The flap 562 seats against a seal surface 564 in its unbiased state to resist movement in a first direction and form a seal to prevent inflow (indicated by directional arrow I) of material into the contained volume, but can flex in a second direction to allow discharge or outflow (indicated by directional arrow O) of material from the contained volume. The provision of one-way flow control to the containment and dispensing system 510 may be utilized, for example, in prefilled dispensing systems to prevent inadvertent introduction of contaminants or other materials to the contained volume, to prevent drawing air into the contained volume, and/or for various other applications.

Figure 21B:
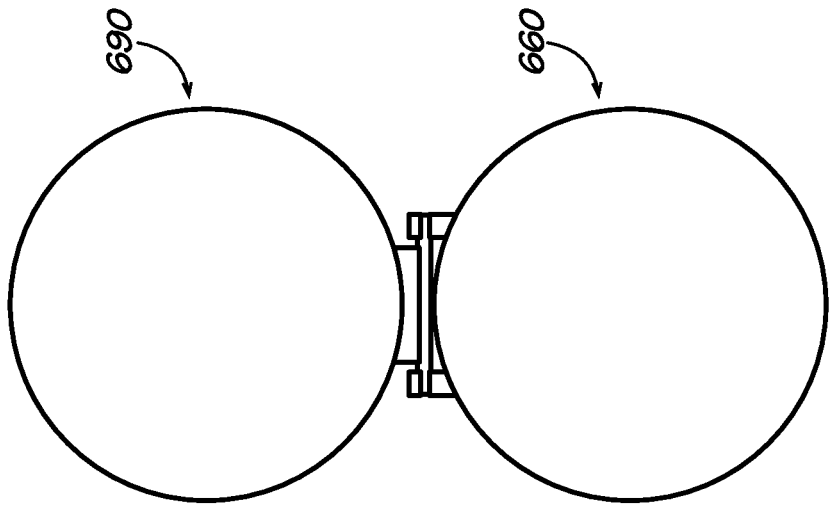
FIGS. 21A-21B show a containment and dispensing system having a detachable hinged cover, according to another example embodiment of the present invention.
Figure 21A:
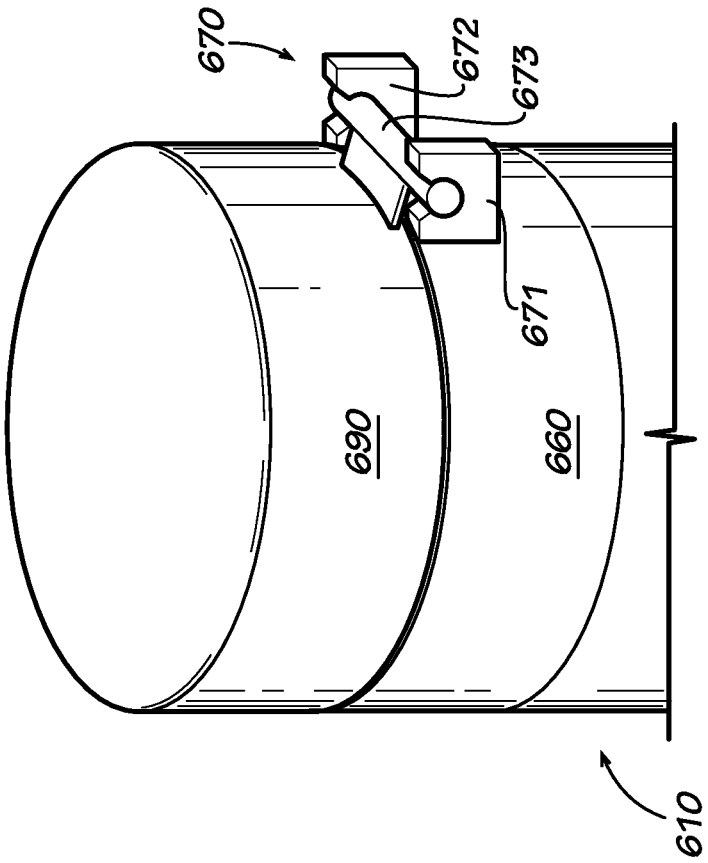

FIGS. 21A, 21B show a further embodiment of a fluid containment and dispensing system 610 including a hollow, generally cylindrical containment barrel 620, a movable plunger 40, a dispensing and sealing head 660, and a closure cap 690. In this embodiment, the closure cap is hingedly and removably coupled to the head 660 using a hinge 670 having open hinge sockets 671, 672 formed with the sealing head 660 and a hinge pin or axle 673 formed with or connected to the closure cap 690. The hinge pin 673 may be snapped into or out of the open hinge sockets 671, 672 to couple and uncouple the closure cap to the sealing head. Moreover, the closure cap can also be pivoted between closed and open positions, such as those depicted in these two figures.

While the invention has been described with reference to preferred and example embodiments, it will be understood by those skilled in the art that a variety of modifications, additions and deletions are within the scope of the invention, as defined by the following claims.

What is claimed is:

1. A fluid containment and dispensing system for containing and/or dispensing fluid while maintaining the fluid fresh and aseptic and protecting against contamination, the system comprising:

a variable-volume primary container defining an interior volume having a bore and having a movable plunger slidably mounted within the bore so as to vary the contained volume of the primary container as the movable plunger slides within the bore;

a closure fitted to the variable-volume primary container, the closure comprising a substantially rigid cap for capping the variable-volume primary container and a cover for covering the cap; and a flexible seal insert retained at the closure and comprising an outer seal panel and an inner seal ring spaced at a depth from the outer seal panel and projecting inwardly from an interior wall of the flexible seal insert, the outer seal panel being perforated by a slit to provide selected access to the inner seal ring as desired, while protecting the inner seal ring against contamination.

2. The fluid containment and dispensing system of claim 1, wherein with the cover covering the cap the outer seal panel seals against an underside surface of the cap.

3. The fluid containment and dispensing system of claim 2, wherein the cover is provided with concentric sealing ridges for engaging the outer seal panel.

4. The fluid containment and dispensing system of claim 1, wherein the slit comprises a resealable cross-slit.

5. The fluid containment and dispensing system of claim 1, wherein the cover is hingedly coupled to the cap.

6. The fluid containment and dispensing system of claim 1, wherein the cover is detachably coupled to the cap.

7. The fluid containment and dispensing system of claim 1, wherein the cap includes a substantially cylindrical port and the flexible seal insert includes a first sealing surface for sealing against an outside annular portion of the cylindrical port, a second sealing surface for sealing against a middle cylindrical portion of the port, and a third sealing surface for sealing against an inside annular portion of the cylindrical port.

8. The fluid containment and dispensing system of claim 7, wherein the inner seal ring of the flexible seal insert is positioned adjacent and interiorally of the second sealing surface of the flexible seal insert.

9. The fluid containment and dispensing system of claim 1, wherein with the cover uncovering the cap, an attachment can be fitted to closure, with the attachment including a tubular element extending through the flexible seal insert for accessing the variable-volume primary container.

10. The fluid containment and dispensing system of claim 9, wherein the attachment comprises a fluid dispensing nipple for permitting an infant to suckle fluid contained within the variable-volume primary container.

11. The fluid containment and dispensing system of claim 9, wherein the attachment comprises a secondary fluid container for transferring fluid to and/or from the variable-volume primary container.

12. The fluid containment and dispensing system of claim 11, wherein the secondary fluid container for transferring fluid to and/or from the variable-volume primary container comprises a movable plunger.

13. The fluid containment and dispensing system of claim 9, wherein the attachment comprises a fluid dispensing nipple with a fluid line extending therefrom for transferring fluid to and/or from the variable-volume primary container.

14. The fluid containment and dispensing system of claim 1, wherein the movable plunger comprises gaskets including two spaced-apart pairs of rounded seal contact faces in sliding abutment with an interior surface of the bore.

15. The fluid containment and dispensing system of claim 1, wherein the internal sealing ring is configured to couple with a standard enteral male connector.

16. The fluid containment and dispensing system of claim 1, further comprising a secondary container having a coupling adapted for sealing engagement with the flexible seal insert.

17. The fluid containment and dispensing system of claim 1, further comprising a plurality of interchangeable sealing head configurations.

18. The fluid containment and dispensing system of claim 1, wherein the seal insert is configured for coupling to a standard enteral fitting.

19. The fluid containment and dispensing system of claim 1, wherein the flexible seal insert is adapted to receive a tubular element therethrough for accessing the variable-volume primary container.

20. The fluid containment and dispensing system of claim 1, wherein the seal insert defines a fluid conduit extending therethrough, and wherein the internal sealing ring is spaced at a depth from the sealing panel and defines an inner diameter configured to sealingly engage a corresponding coupling.

21. The fluid containment and dispensing system claim 20, further comprising a raised external seal ring about a periphery of the sealing panel.

22. A containment and dispensing system as claimed in claim 1 further comprising a contained volume and a one-way flow control mechanism for allowing discharge of material from the contained volume and resisting introduction of material into the contained volume.

23. The containment and dispensing system of claim 22, wherein the one-way flow control mechanism comprises a series of inclined ridges along at least a portion of an interior face of the barrel, and a portion of the plunger interacting with the inclined ridges to allow translation of the plunger in a first direction and prevent translation of the plunger in a second direction.

24. A containment and dispensing system comprising a contained volume, a closure fitted to the contained volume, a flexible seal insert retained at the closure, and a one-way flow control mechanism, the flexible seal insert comprising an outer seal panel and an inner seal ring spaced from the outer seal panel, wherein the outer seal panel is perforated by a slit to provide selected access to the inner seal ring as desired while protecting the inner seal ring against contamination, and wherein the one-way flow control mechanism is spaced from the inner seal ring for allowing discharge of material from the contained volume and resisting introduction of material into the contained volume.

25. The containment and dispensing system of claim 24, comprising a barrel and a plunger translationally mounted within the barrel, and wherein the one-way flow control mechanism comprises a series of inclined ridges along at least a portion of an interior face of the barrel, and a portion of the plunger interacting with the inclined ridges to allow translation of the plunger in a first direction and prevent translation of the plunger in a second direction.

26. The containment and dispensing system of claim 24, further comprising a discharge nozzle, and wherein the one-way flow control mechanism comprises a unidirectional flexible flap that seats against a seal to resist movement in a first direction to prevent inflow of material, and can flex in a second direction to allow outflow of material.

27. A fluid containment and dispensing system for containing and/or dispensing fluid while maintaining the fluid fresh and aseptic and protecting against contamination, the system comprising:

a variable-volume primary container defining an interior volume having a bore and having a movable plunger slidably mounted within the bore so as to vary the contained volume of the primary container as the movable plunger slides within the bore;

a closure fitted to the variable-volume primary container, the closure comprising a substantially rigid cap for capping the variable-volume primary container and a cover for covering the cap; and a flexible seal insert retained at the closure and comprising an outer seal panel and an inner seal ring spaced at a depth from the outer seal panel and projecting inwardly from an interior wall of the flexible seal insert, the outer seal panel being perforated by a slit to provide selected access to the inner seal ring as desired, while protecting the inner seal ring against contamination;

wherein the cap includes a substantially cylindrical port and the flexible seal insert includes a first sealing surface for sealing against an outside annular portion of the cylindrical port, a second sealing surface for sealing against a middle cylindrical portion of the port, and a third sealing surface for sealing against an inside annular portion of the cylindrical port.

28. The fluid containment and dispensing system of claim 27, wherein the inner seal ring of the flexible seal insert is positioned adjacent and interiorally of the second sealing surface of the flexible seal insert.

* * * * *